US009080822B2

(12) United States Patent
Lamb

(10) Patent No.: US 9,080,822 B2
(45) Date of Patent: Jul. 14, 2015

(54) RELOADING SYSTEM

(71) Applicant: Ronald Michael Lamb, Santa Clara, CA (US)

(72) Inventor: Ronald Michael Lamb, Santa Clara, CA (US)

( * ) Notice: Subject to any disclaimer, the term of this patent is extended or adjusted under 35 U.S.C. 154(b) by 0 days.

(21) Appl. No.: 14/020,718

(22) Filed: Sep. 6, 2013

(65) Prior Publication Data

US 2014/0137453 A1 May 22, 2014

Related U.S. Application Data

(60) Provisional application No. 61/698,315, filed on Sep. 7, 2012.

(51) Int. Cl.

| | |
|---|---|
| ***F41A 3/66*** | (2006.01) |
| ***F41A 9/01*** | (2006.01) |
| ***F41A 9/64*** | (2006.01) |
| ***F41A 9/70*** | (2006.01) |

(52) U.S. Cl.

CPC ... *F41A 9/64* (2013.01); *F41A 9/01* (2013.01); *F41A 9/70* (2013.01)

(58) Field of Classification Search

CPC ..... F41A 9/64; F41A 9/65; F41A 9/66; F41A 9/70

USPC ..... 42/6, 16, 49.01, 49.02; 89/33.01, 33.03, 89/33.1, 33.5

See application file for complete search history.

(56) References Cited

U.S. PATENT DOCUMENTS

| | | | | |
|---|---|---|---|---|
| 4,864,758 | A * | 9/1989 | Crossman | 42/18 |
| 5,771,620 | A * | 6/1998 | Crawford et al. | 42/19 |
| 6,070,352 | A * | 6/2000 | Daigle | 42/49.02 |
| 6,564,691 | B2 * | 5/2003 | Butler | 89/191.01 |
| 6,912,806 | B2 * | 7/2005 | Malindretos | 42/17 |
| 8,418,390 | B1 * | 4/2013 | Wright | 42/49.01 |
| 8,756,846 | B1 * | 6/2014 | Lemoine | 42/69.01 |
| 2007/0089346 | A1 * | 4/2007 | Merlino | 42/17 |
| 2012/0066950 | A1 * | 3/2012 | Davidson | 42/50 |

* cited by examiner

*Primary Examiner* — Bret Hayes

(74) *Attorney, Agent, or Firm* — Ariel S. Bentolila; Bay Area IP Group LLC

(57) ABSTRACT

A reloading system for modifying an existing discharge assembly such that it operates with a magazine containing multiple rounds of at least one projectile. The system joins with the discharge assembly without permanently altering the discharge assembly. A magazine joins with a receiver on the discharge assembly. A magazine well secures the magazine to the receiver. A magazine adapter connects the magazine to the receiver. A ramp guides the projectiles from the magazine into a barrel. A magazine spring presses the projectiles against rear feed lips for extraction into the barrel. A projectile pickup extracts the projectile from the magazine and moves it to the barrel for discharge.

20 Claims, 9 Drawing Sheets

RELOADING SYSTEM

CROSS-REFERENCE TO RELATED APPLICATIONS

The present Utility patent application claims priority benefit of the U.S. provisional application for patent Ser. No. 61/698,315 entitled "Magazine fed shotgun conversion system", filed on Sep. 7, 2012 under 35 U.S.C. 119(e). The contents of this related provisional application are incorporated herein by reference for all purposes to the extent that such subject matter is not inconsistent herewith or limiting hereof

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to reloading a discharge device. More particularly, the invention relates to modifying a discharge assembly to reload more efficiently and quickly.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a gun is a normally tubular weapon or other device designed to discharge projectiles or other material.

Typically, most guns use compressed gas confined by the barrel to propel the bullet up to high speed, though devices operating in other ways are sometimes called guns. In firearms that are gun the high-pressure gas is generated by combustion, usually of gunpowder. The projectile is most often reloaded manually.

Often, tubular magazine repeating shotguns have structure, which restricts the number of shotgun shells that can be loaded in its magazine, typically 3 to 5 rounds. When all shells in the tubular magazine have been fired, it is necessary to manually load one shell at a time into the magazine tube.

In many instances, the prolonged period for reloading presents a dangerous risk to those in harms way as the weapon is not capable of being fired during this period. This limit shell capacity the shotgun also affects sporting shooters when competing in competitions.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A illustrates an exemplary discharge assembly without a reloading system, and FIG. 1B illustrates an exemplary discharge assembly with an exemplary reloading system, in accordance with an embodiment of the present invention;

FIG. 3A illustrates an exemplary magazine, and FIG. 3B illustrates an exemplary disassembled magazine, in accordance with an embodiment of the present invention;

FIG. 4A illustrates an exemplary magazine adapter, and FIG. 4B illustrates an exemplary magazine adapter disassembled, in accordance with an embodiment of the present invention; FIG. 5A illustrates an exemplary bolt positioned over an exemplary projectile assembly, and FIG. 5B illustrates an exemplary projectile pickup, in accordance with an embodiment of the present invention.

Figure 1A:
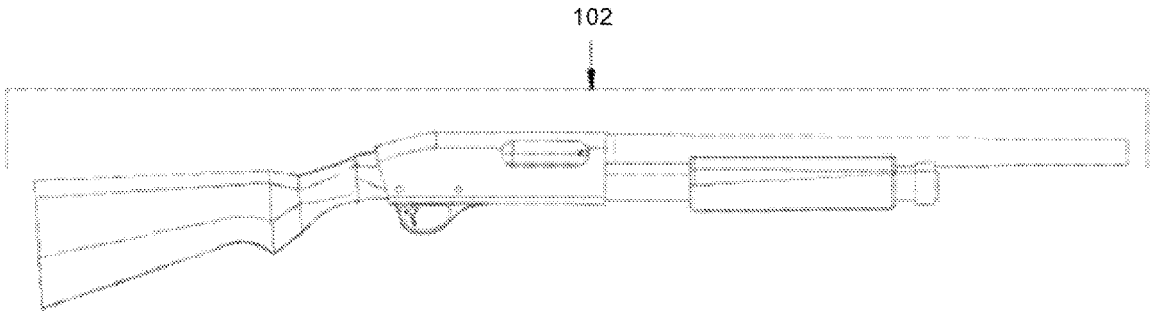
FIGS. 1A and 1B illustrate side views of exemplary discharge assemblies, where

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

The present invention will now be described in detail with reference to embodiments thereof as illustrated in the accompanying drawings.

There are various types of reloading systems for discharge assemblies that may be provided by preferred embodiments of the present invention. In one embodiment of the present invention, the reloading system may help modifying an existing discharge assembly such that it operates with a magazine containing multiple rounds of at least one projectile. The reloading system may join with the discharge assembly without permanently altering the discharge assembly. Additionally, the reloading system may be configured to be quickly and easily attached and removed from the discharge assembly.

In one embodiment of the present invention, the reloading system initially requires an original carrier to be removed from the discharge assembly prior to joining with the discharge assembly. The reloading system, in essence, replaces the original carrier. In some embodiments, a magazine for carrying the at least one projectile, may join with the discharge assembly. The magazine may include rear feed lips for retaining the at least one projectile inside. Inside the magazine, a magazine spring may be compressed by the loaded projectile, thus allowing multiple projectiles to be loaded into the magazine at once. The tension created by the magazine spring may serve to push the at least one projectile upward along a longitudinal axis of the magazine, thereby pressing the at least one projectile against the rear feed lips. The magazine may further comprise a ramp for guiding the at least one projectile from the magazine to the barrel. The ramp may also help inhibit jamming in the discharge assembly.

A magazine adapter may join the magazine to the discharge assembly. The magazine adapter may be positioned afore a trigger. The magazine adapter may join, from a proximal end, to a bottom surface and a side of a receiver on the discharge assembly. The receiver may accept the at least one projectile for chambering into the barrel. The magazine adapter may be configured to guide the at least one projectile into a rear section of the barrel through a ramp, where the at least one projectile may be discharged. A magazine well may serve to secure the connection between the magazine and the magazine adapter.

In some embodiments, a slide assembly may join with a fore end tube for helping to move the at least one projectile through the discharge assembly. The slide assembly on the existing discharge assembly may be replaced by the projectile pickup. The projectile pickup may include a spring loaded pivoting projectile pickup bar. The pivoting motion of the projectile pickup bar may pivot upward into a locking block of the projectile pickup when moved rearwardly over the at least one projectile in the magazine. Additionally, the projectile pickup bar may extend downwardly at its rearmost position thus allowing the projectile pickup bar to strip at least one projectile from the top of the magazine and load it into the rear of the barrel.

In operation, the projectile pickup may start in its rearward most position. The at least one projectile may be pushed up by the magazine through the magazine well and into the receiver. For loading the at least one projectile into the barrel, the projectile pickup would move to a forward position. The projectile pickup bar, which is secured to the slide assembly, may then move in coordination with the slide assembly. This movement may cause a top projectile that has been loaded into the magazine to be released from the magazine into the receiver. The at least one projectile may then be fed into the rear of the barrel as the slide assembly continues forwardly. Finally, the discharge assembly may be discharged. Once fired the projectile pickup and a bolt become fixedly secured so that they function as a single unit. The projectile pickup and the bolt may be drawn to the rear section of the discharge assembly thus unlocking the bolt and moving the bolt rearwardly and extracting the at least one projectile from the rear of the barrel. In some embodiments, the bolt may eject the at least one projectile as it moves rearwardly, the projectile pickup bar may then pass over a new projectile inside the magazine for extraction. The process may then be repeated with the projectile pickup drawn forwardly.

Figure 1B:
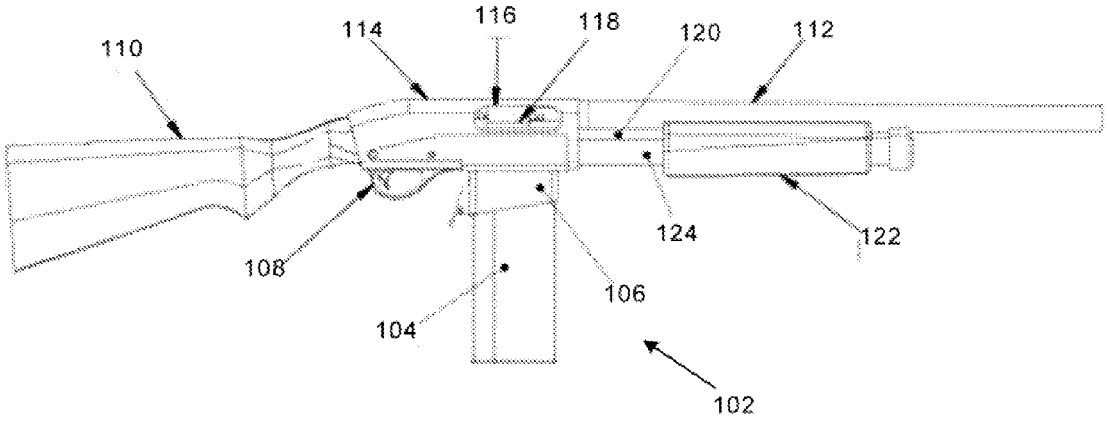

FIGS. 1A and 1B illustrate side views of exemplary discharge assemblies, where FIG. 1A illustrates an exemplary discharge assembly without a reloading system, and FIG. 1B illustrates an exemplary discharge assembly with an exemplary reloading system, in accordance with an embodiment of the present invention. In the present invention, a reloading system 100 may help modifying an existing discharge assembly 102 such that it operates with a magazine 104 containing multiple rounds of at least one projectile. The reloading system may join with the discharge assembly without permanently altering the discharge assembly. Additionally, the reloading system may be configured to be quickly and easily attached and removed from the discharge assembly. In some embodiments, the reloading system may initially require an original carrier to be removed from the discharge assembly prior to joining with the discharge assembly. The reloading system, in essence, replaces the original carrier. Suitable materials for fabricating the reloading system may include, without limitation, steel, iron, aluminum, metal alloy, wood, and fiberglass.

In one embodiment of the present invention, a magazine for carrying the at least one projectile, may join with the discharge assembly. The magazine may include rear feed lips for retaining the at least one projectile inside. Inside the magazine, a magazine spring may be compressed by the loaded projectile, thus allowing multiple projectiles to be loaded into the magazine at once. The tension created by the magazine spring may serve to push the at least one projectile upward along a longitudinal axis of the magazine, thereby pressing the at least one projectile against the rear feed lips. The magazine may further comprise a ramp for guiding the at least one projectile from the magazine to the barrel. The ramp may also help inhibit jamming in the discharge assembly.

A magazine adapter 106 may join the magazine to the discharge assembly. The magazine adapter may be positioned afore a trigger. The magazine adapter may join, from a proximal end, to a bottom surface and a side of a receiver on the discharge assembly. The receiver may accept the at least one projectile for chambering into the barrel. The magazine adapter may be configured to guide the at least one projectile into a rear section of the barrel through a ramp, where the at least one projectile may be discharged. A magazine well may serve to secure the connection between the magazine and the magazine adapter.

In some embodiments, a slide assembly 120 may join with a fore end tube 122 for helping to move the at least one projectile through the discharge assembly. The slide assembly on the existing discharge assembly may be replaced by the projectile pickup. The projectile pickup may include a spring loaded pivoting projectile pickup bar. The pivoting motion of the projectile pickup bar may pivot upward into a locking block of the projectile pickup when moved rearwardly over the at least one projectile in the magazine. Additionally, the projectile pickup bar may extend downwardly at its rearmost position thus allowing the projectile pickup bar to strip at least one projectile from the top of the magazine and load it into the rear of the barrel.

In one embodiment, the discharge assembly may include a trigger 108 for actuating the discharge assembly. The discharge assembly may further include a stock 110 for carrying and aiming the discharge assembly. A barrel 112 may provide a channel for the at least one projectile to pass through during discharge. A receiver 114 may engage the magazine. A bolt 116 may secure the at least one projectile in place. A slide 118 may push the at least one projectile through the discharge assembly. A magazine tube 124 may carry the at least one projectile on the path to the magazine.

Figure 2:
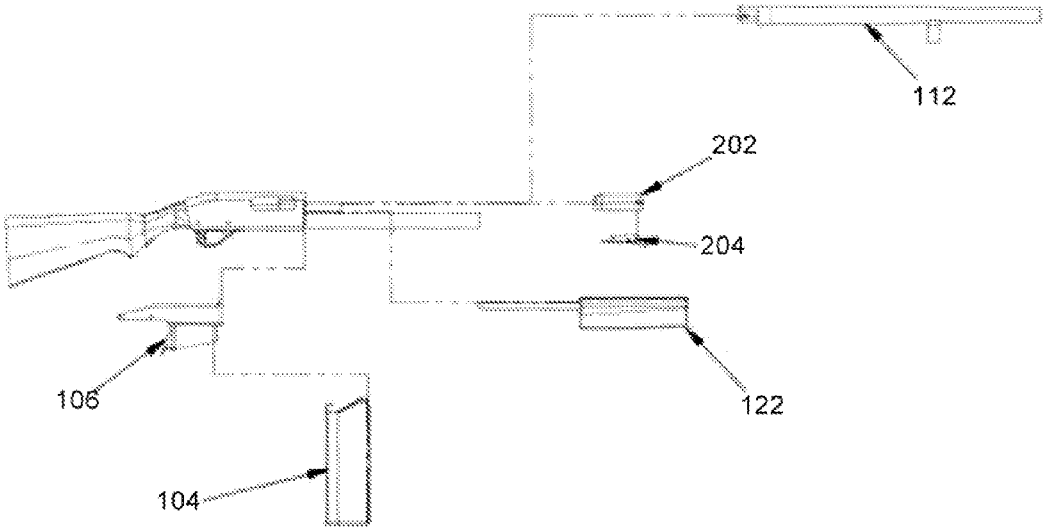
FIG. 2 illustrates a side view of an exemplary discharge assembly disassembled into an exemplary barrel, an exemplary bolt, an exemplary projectile pickup, an exemplary forward tube, in accordance with an embodiment of the present invention.

FIG. 2 illustrates a side view of an exemplary discharge assembly disassembled into an exemplary barrel, an exemplary bolt, an exemplary projectile pickup, an exemplary forward tube, in accordance with an embodiment of the present invention. In the present invention, a projectile pickup 202 may start in its rearward most position. The at least one projectile may be pushed up by the magazine through the magazine well and into the receiver. For loading the at least one projectile into the barrel, the projectile pickup would move to a forward position. A projectile pickup bar 204 may then extract the at least one projectile. The projectile pickup, which is secured to the slide assembly, may then move in coordination with the slide assembly. This movement may cause a top projectile that has been loaded into the magazine to be released from the magazine into the receiver. The at least one projectile may then be fed into the rear of the barrel as the slide assembly continues forwardly. Finally, the discharge assembly may be discharged. Once fired the projectile pickup and a bolt become fixedly secured so that they function as a single unit. The projectile pickup and the bolt may be drawn to the rear section of the discharge assembly thus unlocking the bolt and moving the bolt rearwardly and extracting the at least one projectile from the rear of the barrel. In some embodiments, the bolt may eject the at least one projectile as it moves rearwardly, the projectile pickup bar may then pass over a new projectile inside the magazine for extraction. The process may then be repeated with the projectile pickup drawn forwardly.

Figure 3A:
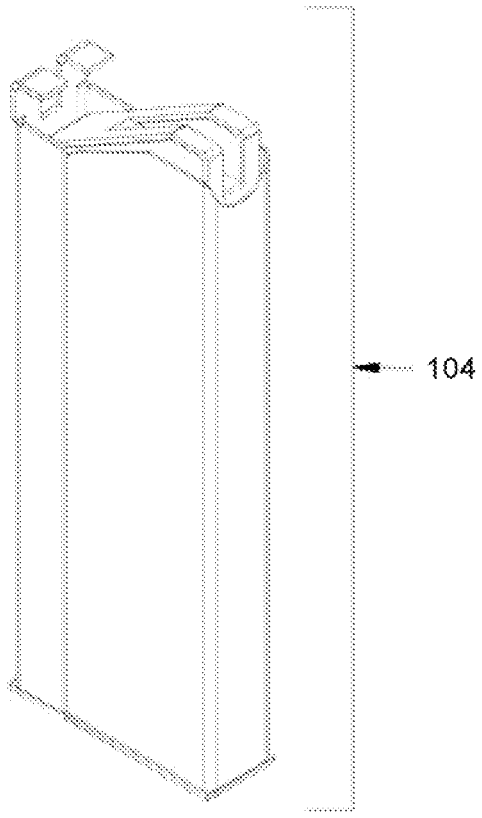
FIGS. 3A and 3B illustrate detailed perspective views of an exemplary magazine, where
Figure 3B:
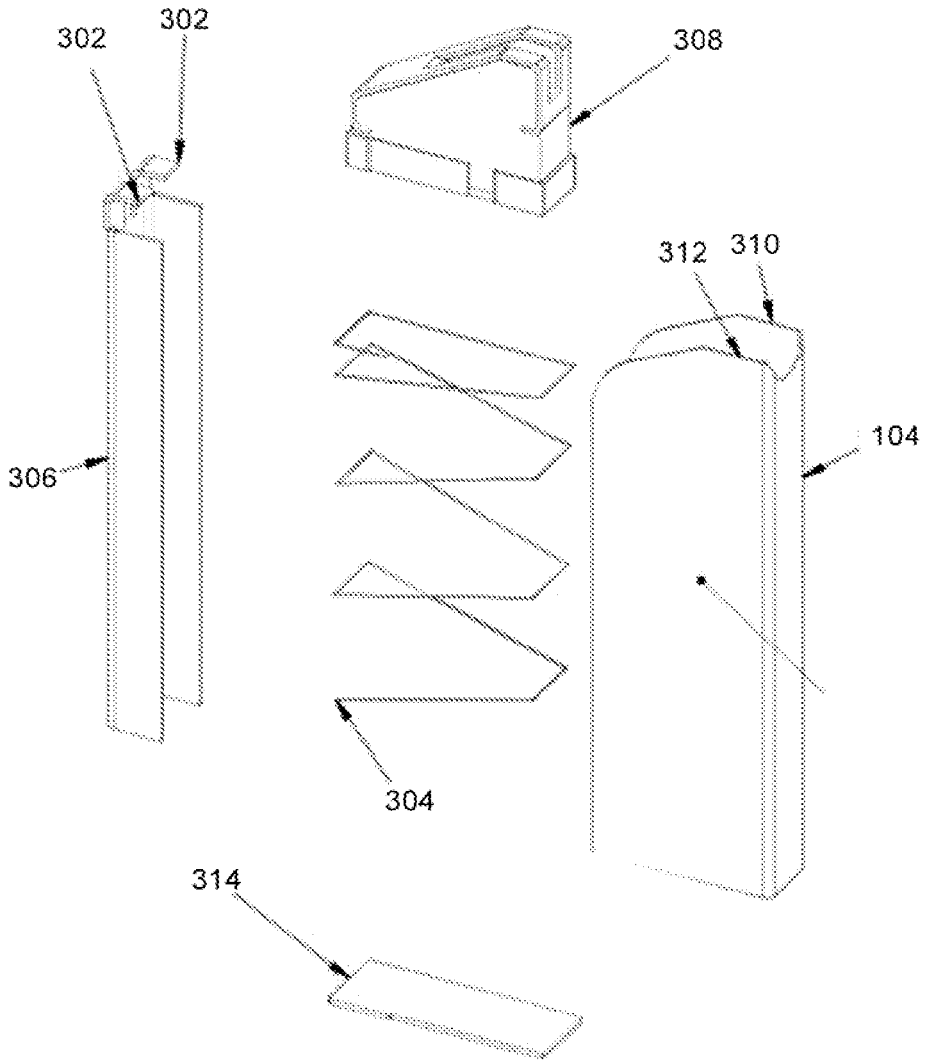

FIGS. 3A and 3B illustrate detailed perspective views of an exemplary magazine, where FIG. 3A illustrates an exemplary magazine, and FIG. 3B illustrates an exemplary disassembled magazine, in accordance with an embodiment of the present invention. In the present invention, a magazine for carrying the at least one projectile, may join with the discharge assembly. The magazine may include a plurality of rear feed lips 302 for retaining the at least one projectile inside. Inside the magazine, a magazine spring 304 may be compressed by the loaded projectile, thus allowing multiple projectiles to be loaded into the magazine at once. The tension created by the magazine spring may serve to push the at least one projectile upward along a longitudinal axis of the magazine, thereby pressing the at least one projectile against the rear feed lips. The magazine may further comprise a ramp for guiding the at least one projectile from the magazine to the barrel. The ramp may also help inhibit jamming in the discharge assembly. A follower 308 may engage the discharge assembly. A right side 310, a left side 312, and a bottom surface 314 may form the sidewalls of the magazine.

Figure 4A:
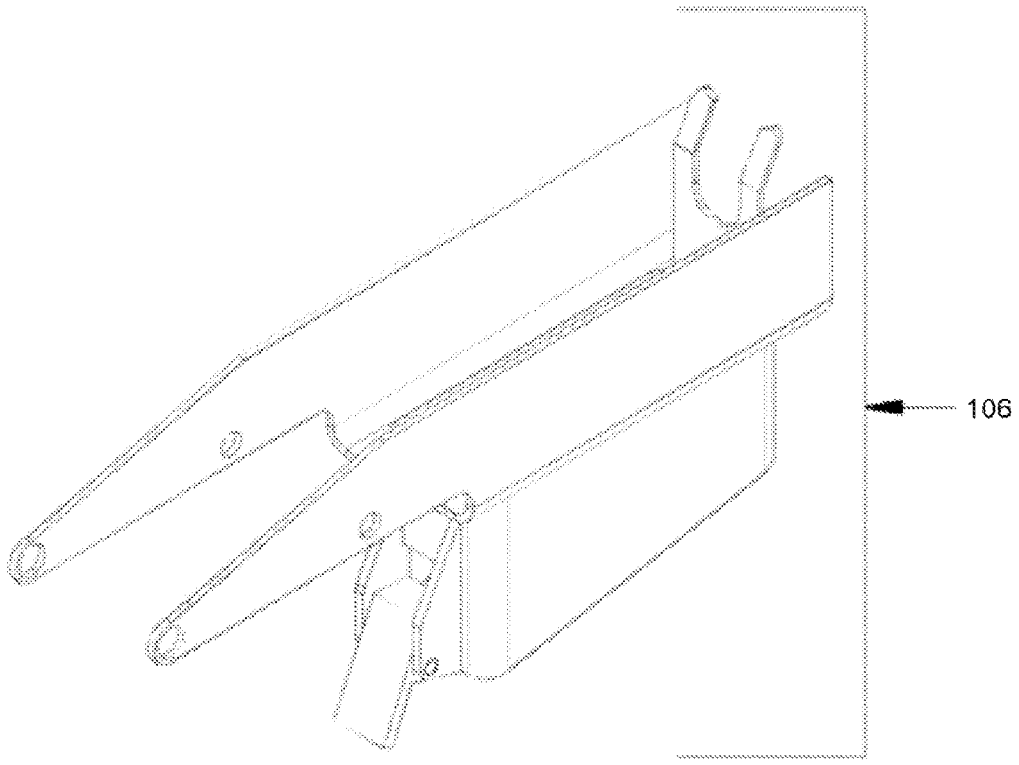
FIGS. 4A and 4B illustrate detailed perspective views of an exemplary magazine adapter, where
Figure 4B:
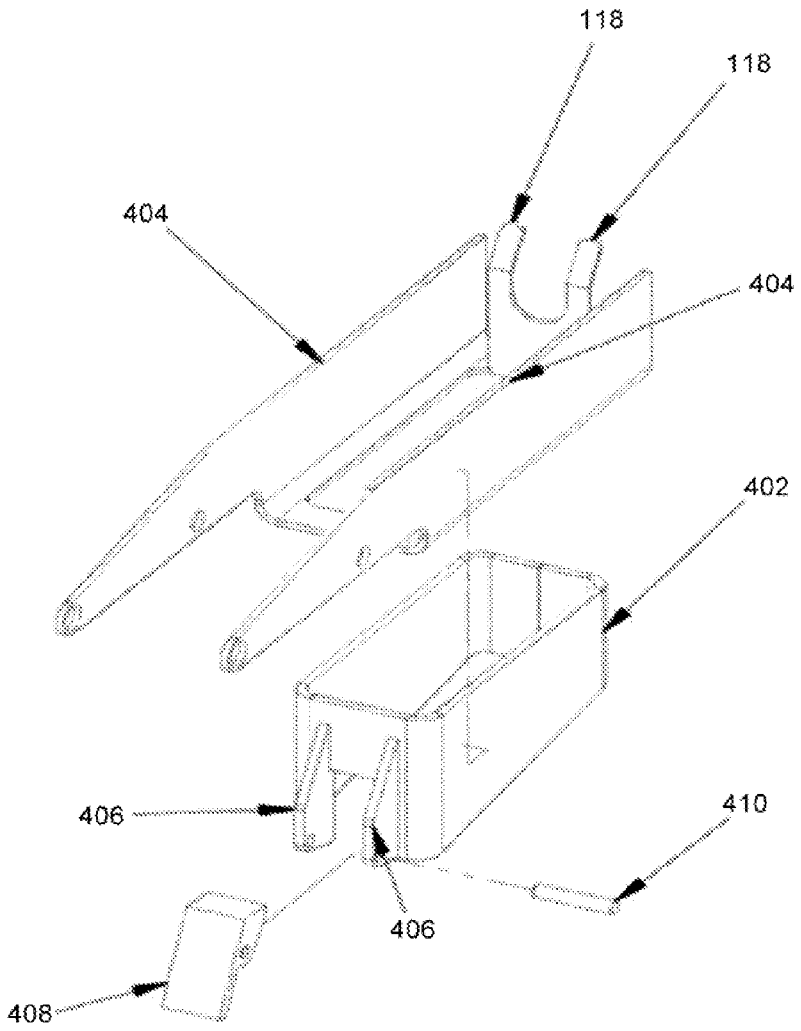

FIGS. 4A and 4B illustrate detailed perspective views of an exemplary magazine adapter, where FIG. 4A illustrates an exemplary magazine adapter, and FIG. 4B illustrates an exemplary magazine adapter disassembled, in accordance with an embodiment of the present invention. In the present invention, the magazine adapter may join the magazine to the discharge assembly. The magazine adapter may be positioned afore a trigger. The magazine adapter may join, from a proximal end, to a bottom surface and a side of a receiver on the discharge assembly. The receiver may accept the at least one projectile for chambering into the barrel. The magazine adapter may be configured to guide the at least one projectile into a rear section of the barrel through a ramp 404, where the at least one projectile may be discharged. A guide wing 406 also helps guide the at least one projectile. A magazine well 402 may serve to secure the connection between the magazine and the magazine adapter. A rear latching mechanism 408 on the rear of the magazine well may allow the magazine to be quickly and easily attached and removed. A fastener 410 may join the rear latching mechanism to the magazine well. The magazine adapter may further include a guide wing for at least partially guiding said at least one projectile.

Figure 5A:
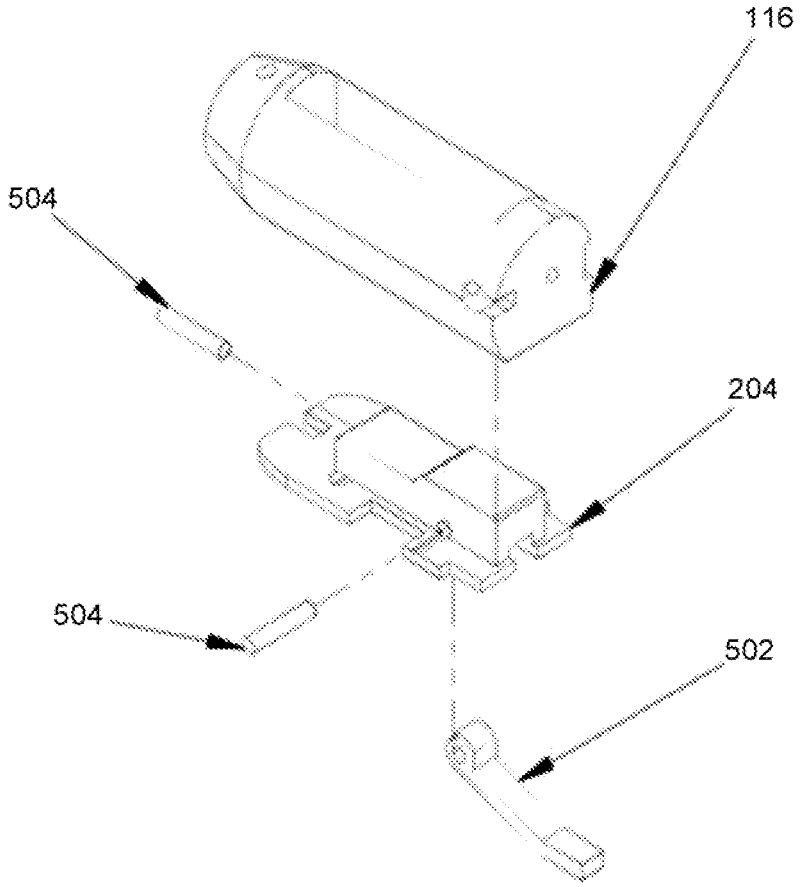
FIGS. 5A and 5B illustrate detailed perspective views of an exemplary bolt over an exemplary projectile pickup, where
Figure 5B:
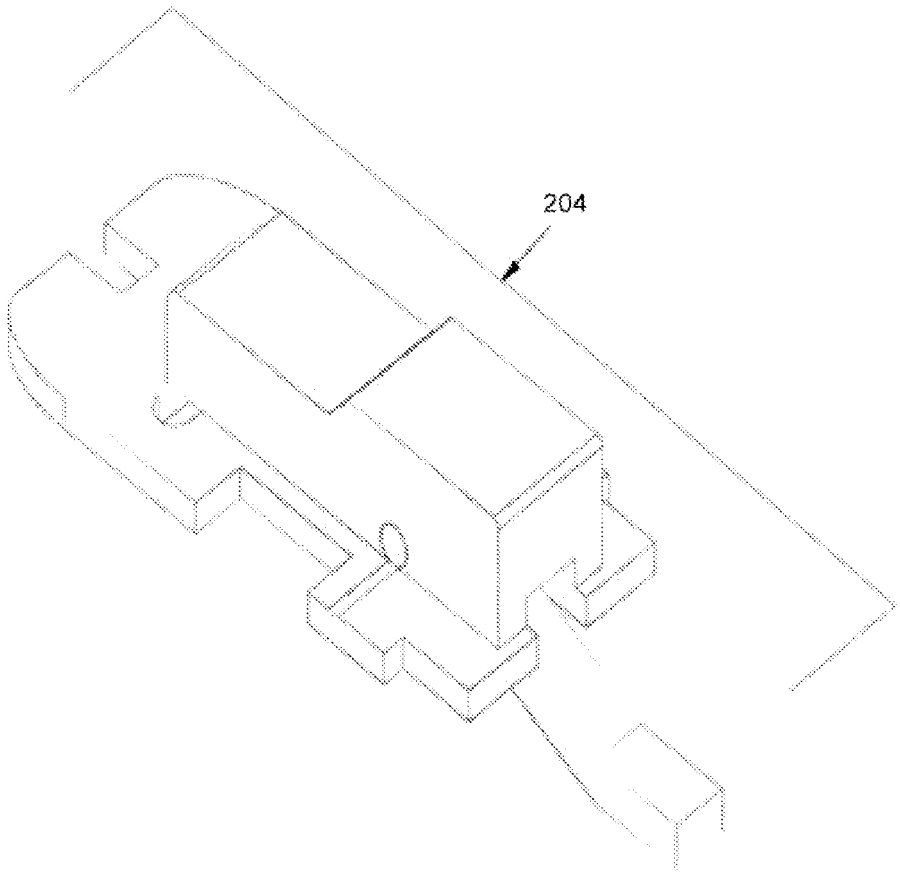

FIGS. 5A and 5B illustrate detailed perspective views of an exemplary bolt over an exemplary projectile pickup, where FIG. 5A illustrates an exemplary bolt positioned over an exemplary projectile assembly, and FIG. 5B illustrates an exemplary projectile pickup, in accordance with an embodiment of the present invention. In the present invention, a slide assembly may join with a fore end tube for helping to move the at least one projectile through the discharge assembly. The slide assembly on the existing discharge assembly may be replaced by the projectile pickup. The projectile pickup may include a spring loaded pivoting projectile pickup bar. The pivoting motion of the projectile pickup bar may pivot upward into a locking block of the projectile pickup when moved rearwardly over the at least one projectile in the magazine. Additionally, the projectile pickup bar may extend downwardly at its rearmost position thus allowing the projectile pickup bar to strip at least one projectile from the top of the magazine and load it into the rear of the barrel. A spring 502 may allow the projectile pick up bar to pivot in a reciprocating manner. At least one pick up bar fastener 504 may secure the projectile pickup bar to the bolt.

In one alternative embodiment, the magazine adapter forms a single piece with the magazine. In yet another alternative embodiment, the projectile pickup bar includes a magnet for picking up the projectile. In yet another alternative embodiment, the projectile pick up does not pivot on a spring, but rather revolves on a chain belt to extract projectiles for depositing into the magazine.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112(1), all claims must be supported by sufficient disclosure in the present patent specification, and any material known to those skilled in the art need not be explicitly disclosed. However, 35 USC §112(6) requires that structures corresponding to functional limitations interpreted under 35 USC §112(6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112(6) when such corresponding structures are not explicitly disclosed in the foregoing patent specification. Therefore, for any invention element(s)/structure(s) corresponding to functional claim limitation(s), in the below claims interpreted under 35 USC §112(6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112(6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112(6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112(6). Applicant(s) note that all the identified documents above which are incorporated by reference to satisfy 35 USC §112(6) necessarily have a filing and/or publication date prior to that of the instant application, and thus are valid prior documents to incorporated by reference in the instant application.

Having fully described at least one embodiment of the present invention, other equivalent or alternative methods of implementing a reloading system for quickly loading projectiles into a discharge assembly according to the present invention will be apparent to those skilled in the art. Various aspects of the invention have been described above by way of illustration, and the specific embodiments disclosed are not intended to limit the invention to the particular forms disclosed. The particular implementation of the reloading system for quickly loading projectiles into a discharge assembly may vary depending upon the particular context or application. By way of example, and not limitation, the reloading system for quickly loading projectiles into a discharge assembly described in the foregoing were principally directed to a reloading system that utilizes a magazine and a projectile pickup to load projectiles into a shotgun with less reloading required implementations; however, similar techniques may instead be applied to large artillery guns, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A system comprising:

a magazine, said magazine being configured to carry at least one projectile, said magazine being configured into engagement with a receiver on a discharge assembly;

a magazine adapter, said magazine adapter being disposed to substantially position between said magazine and said receiver, said magazine adapter being configured to at least substantially guide said at least one projectile forwardly from said magazine to a barrel for discharge;

a bolt, said bolt being configured to extract said at least one projectile from a slide assembly; and a projectile pickup, said projectile pickup being configured to release said at least one projectile from said magazine into said barrel, in which said projectile pickup comprises a projectile pickup bar being disposed to substantially extend downwardly below and forward of a generally bottom surface of said slide assembly, said projectile pickup bar being operable to substantially pivot into a slot in said bottom surface of said slide assembly for delivering said at least one projectile to said magazine adapter, said projectile pickup bar being configured to engage said at least one projectile in proximity to said receiver, said projectile pickup bar being operable to substantially push said at least one projectile forwardly into said barrel for discharging.

2. The device of claim 1, in which said discharge assembly being configured to discharge said at least one projectile, said discharge assembly comprising said receiver, said receiver comprising a front end, a rear end, a top surface, and a bottom surface, said discharge assembly further comprising said barrel, said barrel comprising a rear section, said rear section being disposed to connect to a front section of said receiver, said discharge assembly comprising a stock, said stock comprising a front end, said front end being disposed to engage with said receiver, said discharge assembly further comprising a trigger comprising a front end and a rear end, said trigger being disposed to engage with a trigger aperture in a bottom surface of said receiver.

3. The device of claim 1, wherein a carrier is detached from said discharge assembly prior to engagement with a reloading system.

4. The device of claim 1, in which said magazine comprises a front end, a rear end, a bottom surface, a left side, and a right side.

5. The device of claim 4, in which said magazine comprises a plurality of rear feed lips, said plurality of rear feed lips being configured to retain said at least one projectile inside said magazine.

6. The device of claim 5, in which said magazine comprises a magazine spring, said magazine spring being configured to press said at least one projectile against said plurality of rear feed lips.

7. The device of claim 6, wherein said at least one projectile being configured to compress said magazine spring for creating a spring tension.

8. The device of claim 7, in which said magazine comprises a ramp, said ramp being disposed to position forwardly of said magazine in said bottom surface of said receiver, said ramp being configured to guide said at least one projectile from said magazine to said barrel, said ramp further being configured to help inhibit jamming.

9. The device of claim 8, in which said magazine adapter comprises a guide wing, said guide wing being configured to at least partially guide said at least one projectile, said guide wing being disposed to extend forwardly a predetermined distance adjacent to said receiver.

10. The device of claim 9, in which said system comprises a magazine well, said magazine well being configured to secure said magazine to said receiver.

11. The device of claim 1, in which said slide assembly engages with a fore end tube for helping to move the at least one projectile through the discharge assembly.

12. The device of claim 1, in wherein said projectile pickup bar moves in coordination with said slide assembly.

13. The device of claim 1, in which said projectile pickup comprises a spring loaded reciprocating movement.

14. The device of claim 13, in which said projectile pickup bar is operable to pivot for extracting said at least one projectile.

15. The device of claim 14, in which said projectile pickup bar is operable to pivot upwardly into said slide assembly when moved rearwardly over said at least one projectile.

16. The device of claim 1, in which said projectile pickup bar is disposed to extend downwardly for extracting said at least one projectile from said magazine and loading said at least one projectile into said barrel.

17. The device of claim 1, in which said discharge assembly comprises a shotgun.

18. The device of claim 17, in which said at least one projectile comprises at least one shotgun shell.

19. A system comprising:

means for engaging a receiver with a discharge assembly;

means for engaging a magazine to said discharge assembly;

means for pressing at least one projectile against a plurality of rear feed lips;

means for guiding said at least one projectile through a ramp;

means for engaging said at least one projectile with a projectile pickup;

means for extracting said at least one projectile from said magazine with a projectile pickup bar;

means for pushing said at least one projectile into a barrel for discharge.

20. A system comprising of:

a magazine, said magazine being configured to carry at least one projectile, said at least one projectile comprising at least one shotgun shell, said magazine being disposed to engage with a receiver on a discharge assembly, said discharge assembly comprising a shotgun, said magazine comprising a front end, a rear end, a bottom surface, a left side, and a right side, said magazine further comprising a plurality of rear feed lips, said plurality of rear feed lips being configured to substantially retain said at least one projectile inside said magazine, said magazine further comprising a magazine spring, said magazine spring being configured to press said at least one projectile against said plurality of rear feed lips, said magazine further comprising a ramp, said ramp being disposed to position forwardly of said magazine in said bottom surface of said receiver, said ramp being configured to substantially guide said at least one projectile from said magazine to said barrel, said ramp further being configured to substantially inhibit jamming;

a magazine adapter, said magazine adapter being disposed to generally position between said magazine and said receiver, said magazine adapter being configured to at least partially guide said at least one projectile forwardly from said magazine to a barrel for discharge;

a magazine well, said magazine well being configured to secure said magazine to said receiver;

a bolt, said bolt being configured to extract said at least one projectile from a slide assembly; and a projectile pickup, said projectile pickup being configured to retain said at least one projectile, said projectile pickup being configured to release said at least one projectile from said magazine into said barrel, said projectile pickup comprising a generally reciprocating, spring loaded movement, said projectile pickup being disposed to substantially extend downwardly below and forward of a bottom surface of a slide assembly, said projectile pickup further comprising a projectile pickup bar being operable to pivot into a slot in said bottom surface of said slide assembly for delivering said at least one projectile to said magazine adapter, said projectile pickup bar being configured to engage said at least one projectile in proximity to said receiver, said projectile pickup bar being operable to substantially pivot for extracting said at least one projectile, said projectile pickup bar being operable to push said at least one projectile forwardly into said barrel for discharging, said projectile pickup bar being disposed to substantially extend downwardly for extracting said at least one projectile from said magazine and loading said at least one projectile into said barrel.

* * * * *